US005263842A

United States Patent [19]

Fealey

[11] Patent Number: 5,263,842

[45] Date of Patent: Nov. 23, 1993

[54] NAIL DRIVER WITH IMPROVED NOSEPIECE ASSEMBLY

[75] Inventor: William S. Fealey, Jamestown, R.I.

[73] Assignee: Stanley-Bostitch, Inc., East Greenwich, R.I.

[21] Appl. No.: 35,904

[22] Filed: Mar. 23, 1993

Related U.S. Application Data

[63] Continuation of Ser. No. 860,099, Mar. 30, 1992, abandoned.

[51] Int. Cl.[5] ..... B25C 1/04

[52] U.S. Cl. ..... 227/8; 227/130; 227/142

[58] Field of Search ..... 227/120, 130, 8, 142

[56] References Cited

U.S. PATENT DOCUMENTS

| | | | |
|---|---|---|---|
| 3,519,186 | 7/1970 | Volkmann | 227/8 |
| 3,708,096 | 1/1973 | Burke, Jr. . | |
| 4,197,974 | 4/1980 | Morton et al. | 227/130 |
| 4,404,894 | 9/1983 | Oesterle | 227/130 |
| 4,480,528 | 11/1984 | Shiroyama | 227/130 |
| 4,610,381 | 9/1986 | Kramer et al. | 227/130 |
| 4,657,166 | 4/1987 | Anstett | 227/130 |
| 4,821,937 | 4/1989 | Rafferty | 227/8 |

*Primary Examiner*—Scott Smith

*Attorney, Agent, or Firm*—Cushman, Darby & Cushman

[57] ABSTRACT

A fluid pressure operated nailer in which the fixed nosepiece of the portable housing has an inner portion defining an inner drive track section extending from the fluid pressure chamber in the housing and an outer portion defining an interior guiding recess. A workpiece engaging member defining an outer drive track section is mounted within the interior guiding recess and extends outwardly of the outer end of the fixed nosepiece for movement between an extended workpiece engaging position and a retracted operating position. The inner and outer drive track sections are open laterally to the nail feed track so that a forwardmost nail can be fed from the feed track into the drive track sections. The workpiece engaging member is spring biased into its inoperative position so as to provide positive control of the nail with respect to the driving element during the entire drive stroke including recoil movement of the portable housing.

16 Claims, 4 Drawing Sheets

22
10
20
18
12
14
26
16
24
78
82
80
66
76
74
32
64
42
36
36
34
30
38
72
50
44
48

NAIL DRIVER WITH IMPROVED NOSEPIECE ASSEMBLY

This is a continuation of application Ser. No. 07/860,099, filed on Mar. 30, 1992, now abandoned.

This invention relates to fluid pressure operated fastener driving devices and more particularly to devices of this type which are provided for driving relatively large fasteners such as nails or the like.

All fluid pressure operated fastener driving devices have a characteristic reactionary movement during operation which is frequently referred to as "recoil". When the pressure chamber is pressurized, the pressure acts both downwardly on the movable piston and upwardly on the portable housing. The extent of the recoil movement is a function of the amount of power required to drive the largest fastener in the range of fastener sizes which the tool accommodates. Consequently, the tools which accommodate the largest fasteners, such as large nails, present a situation in which the greatest amount of recoil must be dealt with. In the usual situation, the nosepiece of the tool constitutes a fixed part of the portable housing. The drive track which is open laterally to the nail feed track extends longitudinally through the nosepiece to the outer end thereof. In the usual situation, a contact trip element is mounted with respect to the fixed nosepiece so as to extend beyond the outer end of the fixed nosepiece so as to have a relative movement with respect to the nosepiece as the tool is moved into operative relation with the workpiece. This relative movement commences by virtue of the contact trip element engaging the workpiece when the outer end of the fixed nosepiece is spaced from the workpiece a distance equal to the outward extension of the contact trip element beyond the outer end of the nosepiece. The relative motion occurs thereafter as the outer end of the fixed nosepiece is moved toward the workpiece.

The contact trip element is interrelated with the actuating trigger such that actuation cannot occur unless both (1) the contact trip element has undertaken its relative movement with respect to the outer end of the fixed nosepiece (by virtue of the tool being moved into operative relation with the workpiece as aforesaid) and (2) the trigger has been digitally depressed. In some situations, the interrelationship between the contact trip element and the trigger require the contact trip element to be moved first before the trigger in order for actuation to occur, in which case the outer end of the fixed nosepiece will engage the workpiece prior to actuation so as to be immediately moved away from such workpiece engagement as the recoil movement occurs at the start of the operating cycle immediately after actuation. Consequently, at the end of the drive stroke of the operating cycle when the head of the nail is to engage the workpiece, the outer end of the fixed nosepiece is not on the workpiece to control the final movement of the driver with the nail head.

In other situations, the interrelationship of the contact trip element with the trigger is such that actuation is caused to occur without regard to the sequence in which the contact trip element and trigger are moved. In this situation, when the trigger is digitally depressed first, actuation must occur during the subsequent relative movement of the contact trip element with respect to the fixed nosepiece and in order to insure that actuation will always occur, it is made to occur at a time in its relative movement before the outer end of the fixed nosepiece reaches a position of engagement with the workpiece. Under these circumstances, the outer end of the fixed nosepiece is even further away from the workpiece by virtue of the recoil movement at the time when the nail head is being driven into engagement with the workpiece at the end of the drive stroke of the operative cycle.

It can be seen that, in order for the nail driver to be able to drive the nail head into engagement with the workpiece, the outer end of the driver must extend beyond the drive track and the outer end of the fixed nosepiece at the end of its drive stroke. In many situations, it is desirable to drive the nail head into the workpiece beyond the point of mere engagement so that the striking surface of the nail head is flush with the surface of the workpiece or even countersunk therein. In order to achieve these varying conditions, an adjustment of the position of the outer end portion of the driver with respect to the drive track and the outer end of the fixed nosepiece at the end of the drive stroke must be made. The adjustment can be made either, in one mode, by maintaining the outer end of the fixed nosepiece in a constant position with respect to the workpiece at actuation and varying the final position of the outer end of driver outwardly of the drive track and the outer end of the fixed nosepiece or, in another mode, by varying the position of the fixed nosepiece with respect to the workpiece at actuation and maintaining constant the final position of the outer end portion of the driver outwardly of the drive track and the outer end of the fixed nosepiece. As a practical matter, the second adjustment mode is the one which is utilized commercially rather than the first mode because it can be provided much more economically and effected much more conveniently. The second mode of adjustment merely involves an adjustment in the extent to which the contact trip element extends beyond the outer end of the fixed nosepiece so as to vary the spacing of the outer end of the fixed nosepiece from the workpiece when actuation occurs. Here again, the provision of this type of adjustment can also result in the outer end of the fixed nosepiece being spaced even more from the workpiece when the driver reaches the end of its drive stroke.

This spaced relationship between the outer end of the fixed nosepiece and the outer end of the driver at the end of the drive stroke can result in poor quality-of-drive. This is especially true because in actual practice the recoil movement at the outer end of the nosepiece is not a true rectilinear movement in a direction opposed to the direction of nail drive but because of the position of the handle is a compound movement having a component in the rectilinear direction and a component forwardly which tends to skew the bottom surface of the driver with respect to the striking surface of the nail head. Moreover, it can be seen that quality-of-drive can be more detrimentally effected the more the spacing of the outer end of the nosepiece from the workpiece increases thus permitting more uncontrolled movement with a forward head disengaging component at the end of the drive stroke.

The present invention is based upon the recognition of the analysis set forth above as the cause of the need for improved quality-of-drive and, consequently, an object of the present invention is to fulfill the need for improved quality-of-drive by eliminating or alleviating the cause as analyzed above. In accordance with the principles of the present invention, this objective is obtained by providing a fluid pressure operated nailer comprising a portable housing including a main body portion defining a fluid pressure chamber and a nosepiece operatively fixed with respect to the main body portion. A fluid pressure actuated piston is mounted in the fluid pressure chamber for movement through successive operative cycles each including a drive stroke in one direction by the application of fluid pressure therewith and a return stroke in an opposite direction. The operatively fixed nosepiece has an inner portion defining an inner drive track section extending from the fluid pressure chamber and an outer portion defining an interior guiding recess extending from an outer end of the inner drive track section remote from the fluid pressure chamber toward an outer end of the operatively fixed nosepiece. A workpiece engaging member defining an outer drive track section is mounted within the interior guiding recess and extends outwardly of the outer end of the fixed nosepiece for movement between an extended workpiece engaging position wherein an inner end of the outer drive track section is normally biased to be spaced from the outer end of the inner drive track section and a retracted operating position wherein the outer drive track section is displaced relatively inwardly against the normal bias thereof toward the inner drive track section. A magazine assembly is provided which defines a nail feed track having spaced nail head guiding surfaces and nail shank receiving surfaces extending outwardly therefrom. The magazine assembly serves to feed a supply of nails each having a head and a shank along the nail feed track with the heads guided by the nail head guiding surfaces and the shanks extending between the nail shank receiving surfaces. The inner drive track section defined by the inner portion of the nosepiece is open laterally to an inner section of the feed track including the nail head guiding surfaces and an inner section of the nail shank receiving surfaces and the outer drive track section defined by the workpiece engaging member is open laterally to an outer section of the feed track including an outer section of the nail shank receiving surfaces so that a forwardmost nail can be fed from the feed track into the drive track sections. A fastener driving element is connected with the fluid pressure actuated piston for movement therewith with the drive track sections through successive operative cycles each including a drive stroke for driving a nail fed from the feed track into the drive track sections outwardly thereof and a return stroke. A manually actuated assembly is provided which is operable only when the workpiece engaging member is in the retracted operating position thereof for causing the fluid pressure actuated piston to move through an operating cycle.

Preferably, the manually actuated assembly is mounted with respect to the workpiece engaging member for selective movement into any one of a plurality of adjusted positions so as to provide for adjustment of the extent of movement of the nail head into the workpiece at the end of the drive stroke.

It can be seen that by dividing the drive track into an inner section and an outer section and providing the inner section within the fixed nosepiece and the outer section within a workpiece engaging member mounted for movement within a recess in the fixed nosepiece, control of the driving movement of the nail is maintained throughout particularly the last portion of the movement as the nail head is moved into engagement with the workpiece. Control is provided because the normal bias of the workpiece engaging member maintains it in engagement with the workpiece notwithstanding the movement of the fixed nosepiece away from the workpiece because of the effect of recoil, the effect of workpiece actuation or the effect of nail head penetration adjustment. The control provided results in an improved quality-of-drive.

Another object of the present invention is the provision of a fastener driving device of the type described which is simple in construction, effective in operation, and economical to manufacture and maintain.

These and other objects of the present invention will become more apparent during the course of the following detailed description and appended claims.

The invention may best be understood with reference to the accompanying drawings wherein an illustrative embodiment is shown.

Figure 1:
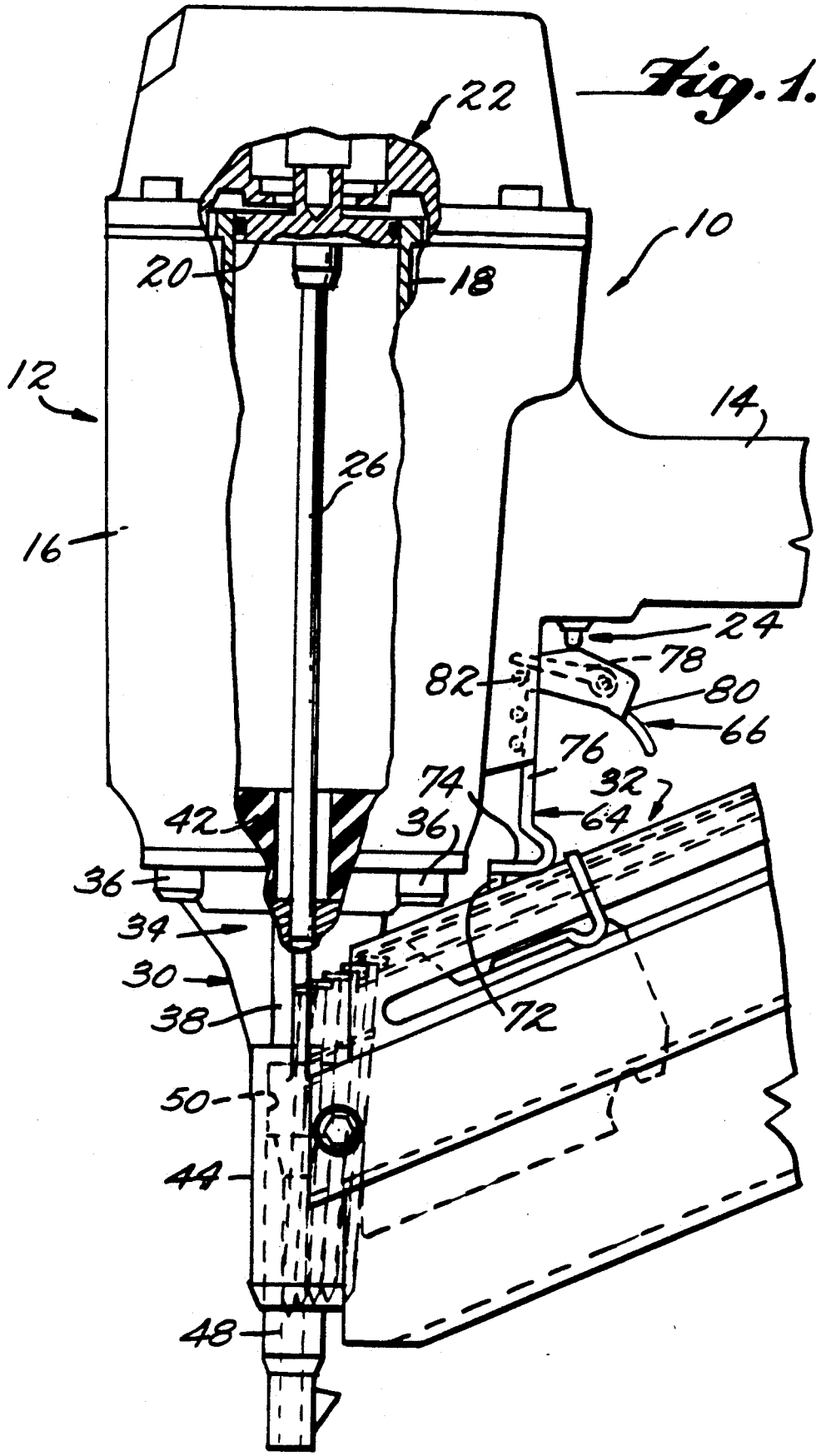
FIG. 1 is a left side elevational view of a fluid pressure operated fastener driving device embodying the principles of the present invention with parts broken away for purposes of clearer illustration.

Referring now more particularly to the drawings, there is shown in FIG. 1 thereof a portable power operated fastener driving device, generally indicated at 10, which embodies the principles of the present invention. The power operated device is of the fluid pressure operated type which includes both an internal combustion operated device as well as a pneumatically operated device, such as specifically illustrated. The device 10 includes the usual portable housing, generally indicated at 12, which includes a handle grip portion 14 of hollow configuration which constitutes a reservoir for air under pressure coming from a source which is communicated therewith. The forward end of the grip portion intersects with a vertical housing portion 16. Mounted within the housing portion 16 is a cylindrical member 18 defining a cylindrical chamber within which a piston 20 is slidably sealingly mounted for movement from an upper position, as shown in FIG. 1, through a drive stroke into a lowermost position and from the lowermost position through a return stroke back into its upper limiting position. A main valve, generally indicated at 22, is provided for controlling communication of the reservoir pressure to the upper end of the cylinder to effect the driving movement of the piston 20. The main valve 22 is pilot pressure operated and the pilot pressure chamber thereof is under the control of an actuating valve, generally indicated at 24. It will be understood that the actuating valve and main valve may be of any known configuration. One example is disclosed in commonly assigned U.S. Pat. No. 3,708,096, the disclosure of which is hereby incorporated by reference into the present specification. Means is provided within the housing 12 to effect the return stroke of the piston 20. For example, such means may be in the form of a conventional plenum chamber return system such as disclosed in the aforesaid patent.

In accordance with the usual practice, a fastener driving element 26 is suitably connected with a piston 20 and is slidably mounted within a drive track formed in a nosepiece assembly, generally indicated at 30, forming a fixed part of the housing 12 which is constructed in accordance with the principles of the present invention.

Fixed to the nosepiece assembly 30 is a magazine assembly, generally indicated at 32, which is operable to receive a supply of fasteners, as, for example, nails and to feed the leading nail of the supply into the drive track to be driven therefrom by the fastener driving element 26. The nails are illustrated as an exemplary fastener to be driven by the device 10 since they constitute the biggest fastener requiring the greatest amount of power to be driven. In the embodiment shown in FIG. 1, the nails are in straight stick form and are of the type which include notched heads enabling the shanks of the nails to be disposed in a shank-to-shank abutting stick and secured thereto as by a pair of wires suitably welded to one side of the shanks. This construction of nail stick is well known and it will be understood that any of the other types may be utilized as well.

The magazine assembly 32, as shown in FIG. 1, is of conventional construction and provides a feed track for receiving a supply of fasteners in stick form as aforesaid and for feeding the supply as by a spring biased pusher so that the forwardmost nail of the stick will enter the drive track. The drive track provided by the nosepiece assembly 30 is open laterally to the feed track of the magazine so as to enable the forwardmost nail in the stick to be fed from the feed track into the drive track.

Referring now more particularly to FIGS. 1-5 of the drawings, the nosepiece assembly 30 includes an operatively fixed nosepiece structure or nosepiece, generally indicated at 34, which is adapted to be fixedly attached to an end of the central body portion 16 of the housing, as by bolts 36 or the like, so as to extend in the direction of the drive track outwardly thereof. The fixed nosepiece 34, while shown as a separate piece fixed by bolts 36 to the housing portion 16, could be formed as an integral part of the housing portion 16. The nosepiece 34 includes an inner position 38 which is exteriorly flanged to receive bolts 36 and interiorly apertured to provide an inner drive track section 40. The drive track section 40 communicates with the end of the pressure chamber provided by the cylinder 18 through a resilient bumper 42 of conventional construction.

The fixed nosepiece 34 also includes an outer portion 44 which has formed on the interior thereof a generally cylindrical guiding recess 46 extending from the outer end of the drive track section 40 toward the outer end of the fixed nosepiece 34.

The nosepiece assembly 30 also includes a workpiece engaging member 48 which is exteriorly cylindrically shaped to slidably engage within the interior guiding recess 46 within the outer portion 44 of the fixed nosepiece 34. The workpiece engaging member 48 extends outwardly of the outer end of the fixed nosepiece 34 and has an outer drive track section 50 formed interiorly therein. The workpiece engaging member 48 is mounted within the guiding recess 46 for movement between an extended workpiece engaging position wherein an inner end of the outer drive track section 50 is normally biased to be spaced from the outer end of the inner drive track section 40 and a retracted operating position wherein the outer drive track section 50 is displaced relatively inwardly against the normal bias thereof toward the inner drive track section 40.

Figure 3:
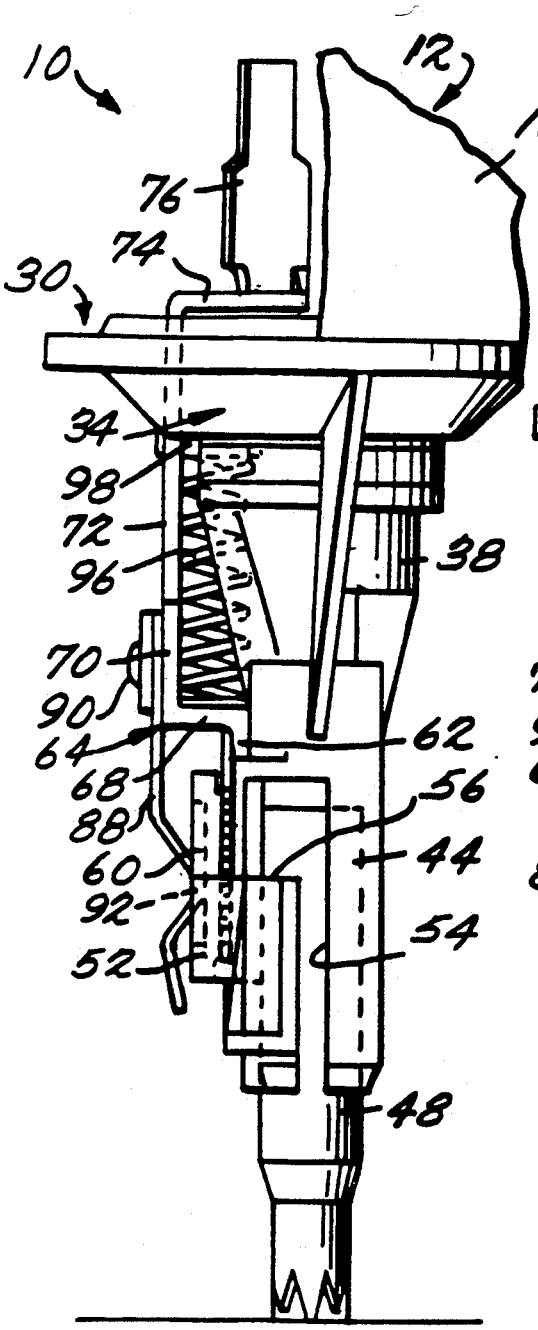
FIG. 3 is a fragmentary front elevational view of the component shown in FIG. 2 with the parts shown in their inoperative position.
Figure 4:
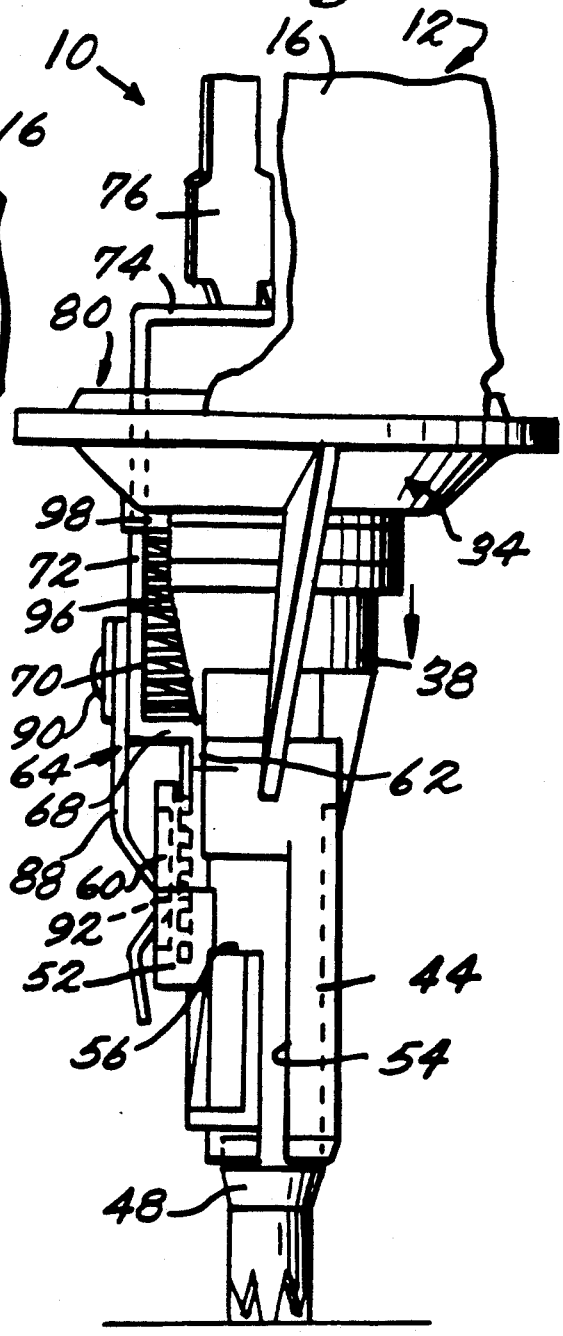
FIG. 4 is a view similar to FIG. 3 with the parts shown in their operative position.
Figure 5:
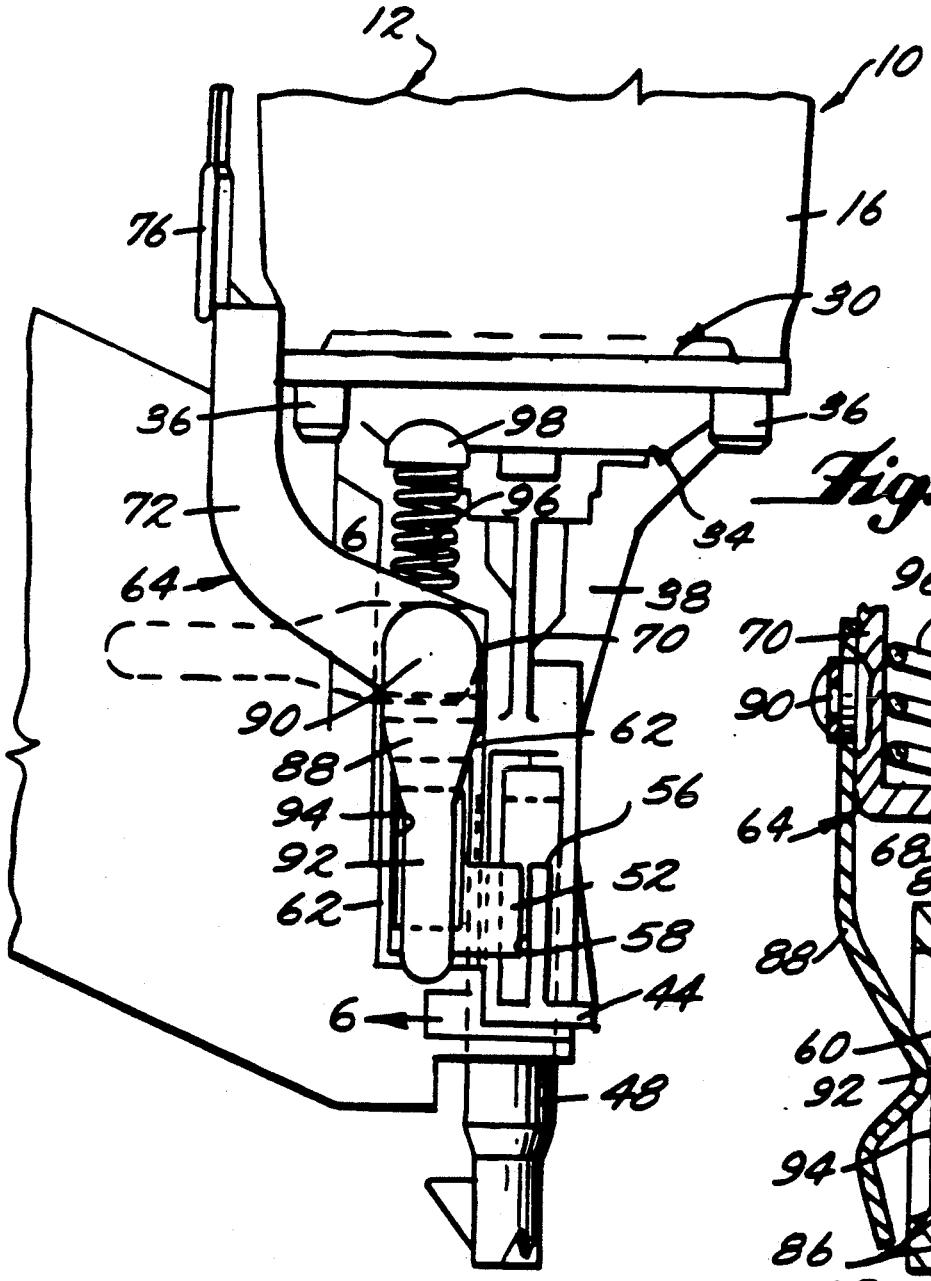
FIG. 5 is a righthand side elevational view of the section shown in FIG. 2.

Referring now more particularly to FIGS. 3-5, preferably the workpiece engaging member 48 includes a mounting arm 52 extending radially outwardly therefrom which serves to restrict the movement of the workpiece engaging member 48 between its two positions to a generally rectangular sliding movement. To this end, the outer portion 44 of the fixed nosepiece 34 has a forwardly disposed slot 54 extending vertically inwardly of the outer end thereof which communicates at its inner end with an arcuate slot 56 which, in turn, communicates with the inner end of a parallel operative slot 58 extending outwardly therefrom. The three slots form essentially an inverted U-shaped slot, the legs of which are formed by the slots 54 and 58 with the slot 56 forming the bight thereof.

It can be seen that the workpiece engaging member 48 is mounted within the guiding recess 46 of the fixed nosepiece 34 by moving the workpiece engaging member 48 inwardly with the arm 52 extending through the slot 54 until the arm 52 reaches the arcuate slot 56 after which the nosepiece engaging member 48 is moved arcuately until the arm 52 reaches the opposite end of the arcuate slot 56. Thereafter, the workpiece engaging member 48 can be moved outwardly so that the arm 52 enters the parallel operative slot 58. It will be noted that the arm 52 extends through the operative slot 58 with minimal clearance so that the workpiece engaging member 48 can have a limited amount of pivotal movement about its axis within the guiding recess 46.

Extending from and fixed to the outer end of the arm 52 is a toothed connecting portion 60 which is adapted to adjustably engage with a cooperating toothed connecting portion 62 of a motion transmitting mechanism, generally indicated at 64. The cooperating toothed connecting portions 60 and 62 provide an adjustable connection between the workpiece engaging member 48 and the motion transmitting mechanism 64 so that the movement of the workpiece engaging member 48 is transmitted to a manual actuating mechanism, generally indicated at 66, operatively connected with the pilot pressure valve mechanism 24.

The motion transmitting mechanism 64 is preferably in the form of a tortuously bent and angulated lever or elongated member one end of which is formed by the toothed connecting portion 62. The toothed connecting portion 62 is mounted on the exterior of the fixed nosepiece 34 for sliding movement with the workpiece engaging member 48. From the end of the toothed connecting portion 62, the lever 64 extends outwardly from the exterior of the fixed nosepiece 34 as indicated at 68, and then extends upwardly, as indicated at 70. As best shown in FIG. 5, from the upward extension 70, the lever 64 extends rearwardly and then upwardly, as indicated at 72. From the rearward and upward extension 72 of the lever 64, there is included a horizontally inwardly extending portion 74 and finally an upwardly extending portion 76 extends upwardly from the horizontal portion 74. As best shown in FIG. 1, the upward portion 76 is guided for vertical movement within the housing 12 so that its upper free end abuttingly engages the free end of a lever arm 78 pivotally mounted on the central portion of a digitally actuated trigger member 80. The trigger member 80 is suitably pivoted at its forward end to the housing 12 as indicated at 82.

The actuating arrangement is such that, when the trigger member 80 is digitally moved from the position shown in FIG. 1 upwardly into an actuating position, the position of the lever arm 78 in its inoperative position as shown in dotted lines, is such that the lever arm 78 will not engage the depending stem of the pilot pressure valve mechanism 24. If the workpiece engaging member 48 is then moved from its inoperative position into its operative position, the upper end of the upward portion 76 of the lever 64 will move the lever arm 78 into engagement with the actuating stem of the pilot pressure actuating valve mechanism 24 to initiate the drive stroke of the piston 20 and fastener driving element 26 therewith. It will also be understood that, if the workpiece engaging member 48 is moved from its inoperative position to its operative position without a digital movement of the trigger member 80 from its inoperative position into its operative position the lever arm 78 will again not be moved into operative engagement with the actuating stem of the pilot pressure actuating valve mechanism 24. Thereafter, a digital movement of the trigger member 80 from its inoperative position into its operative position will have the effect of actuating the pilot pressure valve mechanism 24 to cause the piston 20 to be moved through its drive stroke.

It will be understood that the manual actuating mechanism 66 described above will function to actuate the valve mechanism 24 irrespective of the sequence in which the workpiece engaging member 48 and trigger member 80 are moved into their operative positions. It will also be understood that it is within the contemplation of the present invention to provide a manual actuating mechanism which requires a particular sequence of movements as, for example, an initial movement of the workpiece engaging member into its operative position and then a digital movement of the trigger member into its operative position.

Figure 6:
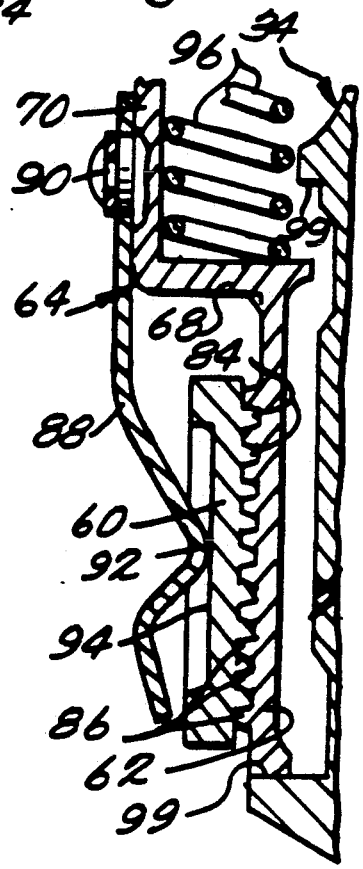
FIG. 6 is a fragmentary sectional view taken along the line 6—6 of FIG. 5.

Referring now more particularly to FIG. 6, it will be noted that the two toothed connecting portions 60 and 62 include two opposed series of vertically spaced teeth 84 and 86 respectively which are capable of cooperatively interengaging with one another in any one of a series of different vertical positions which affect the adjustable connection between the two toothed connecting portions. In this regard, it will be noted that a leaf spring 88 is mounted at one end thereof, as by a pivot pin 90, to the extension 70 of the lever 64 so as to be pivotally movable about a horizontally extending axis between an operative position, such as shown in FIG. 6, and an inoperative adjusting position, such as shown in dotted lines in FIG. 5. It will be understood that, when the leaf spring 88 is in the operative position shown in FIG. 6, a bent intermediate portion 92 thereof resiliently engages within a recess 94 in the connecting portion 60 so as to resiliently bias the same in a direction such that the series of teeth 84 thereof will be biased into meshing relation with the series of teeth 86 of the other connecting portion 62.

The strength of spring 88 is such as to cause the connecting portion to assume a position spaced from the exterior of the fixed nosepiece 34 by a clearance space needed to enable the connecting portions 60 and 62 to be separated. FIG. 6 also illustrates that the ends of the connecting portion 62 are used as vertical movement stops which cooperatively engage oppositely facing abutments 99 on the exterior of the fixed nosepiece to limit the vertical movement of the lever 64 with the workpiece engaging member 48 to a movement between fixed limits and at the same time define both the retracted operative and extended inoperative limiting positions of the workpiece engaging member 48.

It will also be noted that the extension 68 of the lever 64 forms a seat for engaging one end of a helical coil spring 96 which extends upwardly therefrom and has its upper end engaged within a downwardly facing socket portion 98 formed on the exterior of the fixed nosepiece 34. The spring 96 serves to resiliently bias the workpiece engaging member 48 into its inoperative position, as shown in FIG. 3.

Figure 2:
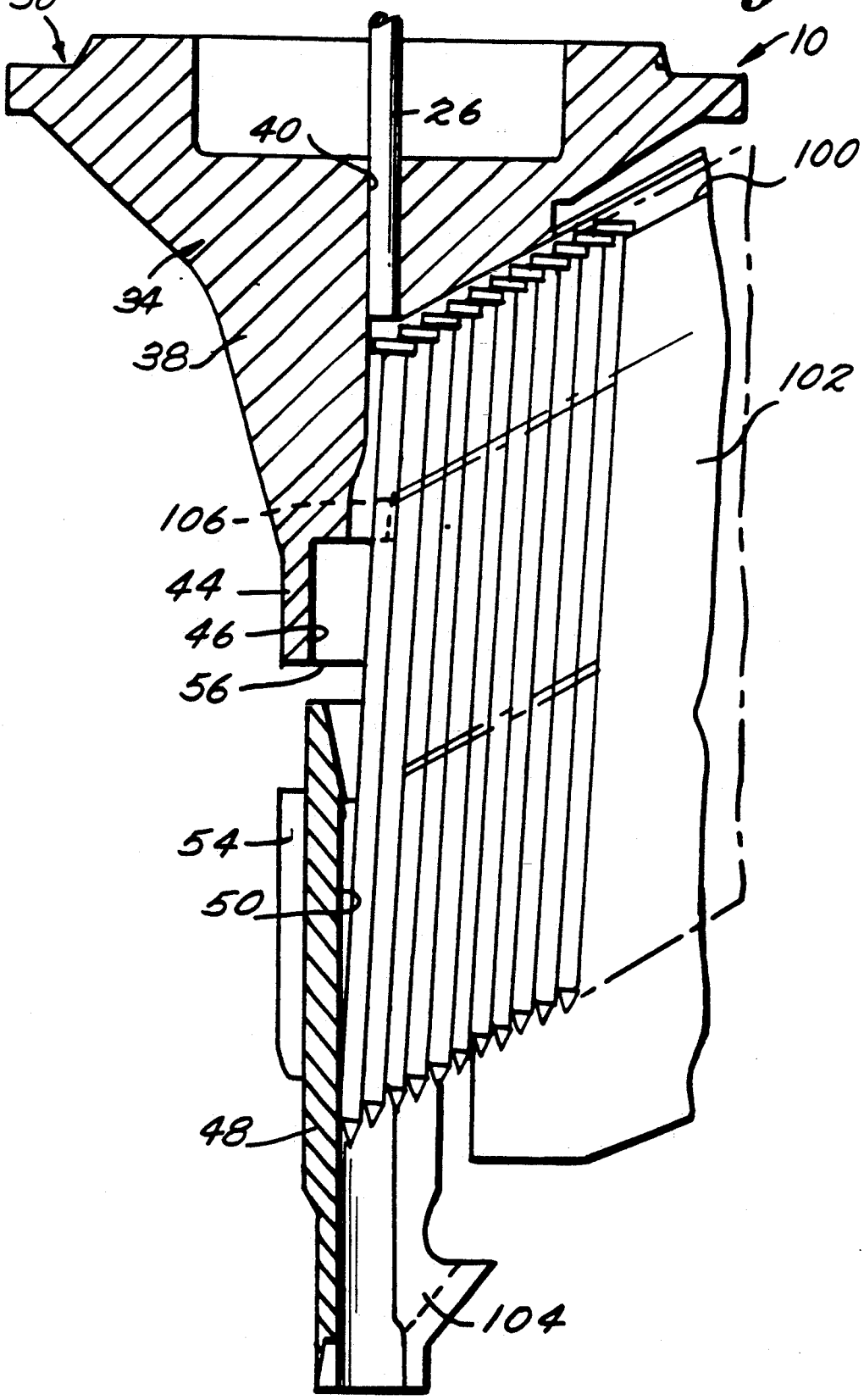
FIG. 2 is an enlarged fragmentary vertical sectional view of the nosepiece section of the device shown in FIG. 1.

Referring now more particularly to FIG. 2, it will be noted that the magazine assembly 32 which is configured to accommodate a supply of nails in a straight stick formation includes a pair of horizontally spaced upwardly facing inclined nail head engaging surfaces 100 which extend into comparable surfaces formed in the fixed nosepiece 34 and communicating with a central portion of the inner drive track section 40. Disposed below the upwardly facing nail head engaging surfaces 100 are oppositely facing nail shank engaging surfaces 102 which likewise extend into comparable surfaces in the fixed nosepiece 34. In this way, the inner drive track section 40 is communicated with the feed track of the magazine assembly 32 which is defined by the surfaces 100 and 102. In this regard, it will be noted that the workpiece engaging member 48 is also rearwardly slotted, as indicated at 104, to communicate the outer drive track section 50 with the feed track.

With the straight stick nail supply and the pusher type magazine, the communication between the feed track and the drive track sections 40 and 50 enable the leading nail of the stick formation to be moved into the drive track sections when the fastener driving element 26 is in its raised position. In this regard, it will be noted that the head of the second nail is supported by the head engaging surfaces 100 while the head of the foremost nail is unsupported by the surfaces 100 in a position within the inner drive track section 40 forwardly thereof. With a nail stick of this type, it is conventional for the leading portion of the head of the leading nail to engage the drive track so that it is beneath the lower end of the fastener driving element 26. The fastener driving element 26 may either be cylindrical or it may have a notched circular cross-sectional configuration which is similar to the nail head.

The manner in which the leading nail is driven by the fastener driving element 26 is entirely conventional. Immediately after being engaged, the fastener driving element 26 strips the leading nail from the remaining nails of the nail stick. After the head of the leading nail has been moved outwardly a short distance within the upper drive section 40, the trailing portions of the head engage cam surfaces 106 which serve to cam the head forwardly within the inner drive track section 40 which is extended forwardly to accommodate the forward movement of the head. Thereafter, the nail head is guided for generally vertical movement through the remainder of the inner drive track section 40 and then through the outer drive track section 50 and into the workpiece. It will be noted that the outer drive track section 50 provides control for the leading nail during its driving movement by the fastener driving element throughout the entire drive stroke thereof. This control includes the lower point end of the nail during the initial movement after which the nail head is first guidingly controlled through an upper frustoconical enlargement at the upper end of the drive track section 50 and then out of the lower end thereof. This desirable functional characteristic is provided by virtue of the longitudinal extent of the outer drive track 50. Moreover, the longitudinal extent of the workpiece engaging member 48 outwardly of the outer end of the fixed nosepiece 34 is substantially greater than the longitudinal extent of movement of the workpiece engaging member 48 from the extended or normal inoperative position to the retracted or operative position thereof and less than the inner portion thereof within the interior guiding recess so as to facilitate toenailing and visibility during operation.

The device 10 is actuated in the manner previously indicated by the operator first grasping the handle portion 14 of the housing 12 and moving the outer end of the workpiece engaging member 48 toward the workpiece to be nailed. As soon as the outer end of the workpiece engaging member 48 engages the workpiece, the operator continues the downward movement of the housing 12 which causes a relative movement between the housing 12 and the motion transmitting lever 64. Thus, the lever 64 moves relatively upwardly so that its upper end portion 76 moves the lever arm 78 upwardly in a position so that a digital upward movement of the trigger member 80 will move the actuating stem of the actuating valve mechanism 24 upwardly to condition the main valve 22 and cause the same to communicate the air under pressure within the reservoir of the housing 12 onto the upper surface of the piston 20 so as to move the same from its upper position downwardly through its drive stroke. The movement of the piston 20 through its drive stroke carries the fastener driving element 26 therewith through its drive stroke. Alternatively, the trigger member 80 may be initially digitally moved and thereafter the workpiece engaging member may be brought into engagement with the workpiece. Under these circumstances, actuation occurs just before the final relative movement of the work piece engaging member 48 with respect to the housing 12.

It will be understood that, when it is desired to adjust the position of the workpiece engaging member 48 so as to ensure that the nail heads will be driven flush or in countersunk relation with the workpiece, spring 88 is flexed outwardly so as to move the intermediate portion 92 out of the recess 94 allowing the spring 88 to be pivoted about the pivot pin 90 into an inoperative position such as shown in dotted lines in FIG. 5. With the spring held out of engagement with the connecting portion 60, the series of teeth 84 on the latter can be moved out of engagement with the teeth 86 by virtue of teeth 86 on portion 62 of operating lever 64 moving into a clearance space provided between portion 62 and fixed nosepiece 34. Pivotal clearance between workpiece engaging member 48 and guiding recess 46 also contributes to facilitate effecting disengagement of the teeth. With the teeth 84 and 86 disengaged, the workpiece engaging member 48 can then be moved as desired within the recess 46 and then reengaged with the series of teeth 84 thereof with the series of teeth 86 at a different level. The adjustment is completed by swinging the leaf spring 88 back into its operative position with the part 92 engaged within the recess 94. The spring 88 thus enables the two connecting portions 60 and 62 to be separated, reengaged, and easily retained in the reengaged position.

It can be seen that, by dividing the drive track into an inner section 40 and an outer section 50 and providing the inner section within the fixed nosepiece and the outer section within a workpiece engaging member mounted for movement within a recess in the fixed nosepiece, control of the driving movement of the nail is maintained throughout particularly the last portion of the movement as the nail head is moved into engagement with the workpiece. Control is provided because the normal bias of the workpiece engaging member provided by spring 96 maintains it in engagement with the workpiece notwithstanding the movement of the fixed nosepiece 48 away from the workpiece because of the effect of recoil, the effect of workpiece actuation or the effect of nail head penetration adjustment. The control provided results in an improved quality-of-drive.

It will also be understood that the invention is not limited to devices 10 which accommodate the utilization of straight stick nail packages but would be equally applicable to devices adapted to use coiled nails of the type having full heads interconnected by parallel wires in spaced relation. It will be understood that, where the device 10 accommodates a nail supply of this type, the magazine would be modified and, in addition, the drive track would not require the cammed surfaces 106. The magazines for accommodating coiled nail packages include a canister within which the coil is mounted and a feeding mechanism in the feed track between the canister and the drive track. The leading nail is usually supported in the drive track section by the wires. It will also be understood that, while the present device is particularly useful in large size pneumatic fastener driving devices, the invention can be applied if desired to devices which drive fasteners which are of a lesser size.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A fluid pressure operated nailer comprising a portable housing including a main body portion defining fluid pressure chamber means and a nosepiece operatively fixed with respect to said main body portion, fluid pressure actuated means mounted in said fluid pressure chamber means for movement through successive operative cycles each including a drive stroke in one longitudinal direction by the application of fluid pressure therewith and a return stroke in an opposite axial direction, said fixed nosepiece having a longitudinally inner portion defining a longitudinally extending inner drive track section extending from said fluid pressure chamber means and a longitudinally extending outer portion defining interior guiding recess means extending from a longitudinally extending outer end of said inner drive track section remote from said fluid pressure chamber means toward a longitudinally extending outer end of said fixed nosepiece, a workpiece engaging member defining a longitudinally extending outer drive track section mounted within said interior guiding recess means, said workpiece engaging means extending longitudinally outwardly from the outer end of said fixed nosepiece for movement in said axial direction between an extended workpiece engaging position wherein a longitudinally extending inner end of said outer drive track section is normally biased to be spaced longitudinally from an outer edge of said interior guiding recess means and a retracted operating position wherein said outer drive track section is displaced relatively longitudinally inwardly within said guiding recess means against the normal bias thereof toward said inner drive track section, a magazine assembly including means defining a nail need track having spaced nail head guiding surfaces and nail shank receiving surfaces extending longitudinally outwardly from said nail head guiding surfaces and means for feeding a supply of nails each having a head and shank along said nail feed track with the heads guided by said nail head guiding surfaces and the shanks extending between said nail shank receiving surfaces, the inner drive track section defined by the inner portion of said nosepiece being open laterally to a longitudinally extending inner section of said feed track including said nail head guiding surfaces and a longitudinally extending inner section of said nail shank receiving surfaces and the outer drive track section defined by said workpiece engaging member being open laterally to a longitudinally extending outer section of said feed track including a longitudinally extending outer section of said nail shank receiving surfaces so that a forwardmost nail can be fed from said feed track into said drive track sections, a fastener driving element connected with said fluid pressure actuated means for movement therewith axially within said drive track sections through successive operative cycles each including a drive stroke for driving a nail fed from said feed track into said drive track sections outwardly thereof and a return stroke, and manually actuated means operable only when said workpiece engaging member is in said retracted operating position for causing said fluid pressure actuated means to move through an operating cycle.

2. A fluid pressure operated nailer as defined in claim 1 wherein said workpiece engaging member includes an annular workpiece engaging longitudinally extending outer end portion and is elongated in the axial direction of movement such that a longitudinally extending outer portion thereof extending outwardly of the outer end of said operatively fixed nosepiece including said annular end portion when in said extended position has an longitudinal extent substantially greater than the longitudinal extent of movement from said extended position to said retracted position and less than an inner portion thereof within said interior guiding recess means so as to facilitate toenailing and visibility during operation.

3. A fluid pressure operated nailer as defined in claim 2 wherein said workpiece engaging member is normally biased into the extended position thereof by spring means acting operatively between said fixed nosepiece and said workpiece engaging member.

4. A fluid pressure operated nailer as defined in claim 3 wherein said portable housing includes a handle fixed to and extending from said main body portion in a position generally above said magazine assembly, said manually actuated means including a trigger member mounted for digital movement by an operator grasping said handle and a motion transmitting mechanism operatively connected between said trigger member and said workpiece engaging member.

5. A fluid pressure operated nailer as defined in claim 4 wherein said manually actuated means includes adjustment means for operatively connecting said motion transmitting mechanism with said workpiece engaging member selectively in any one of a plurality of axially adjusted positions so as to provide for the selective adjustment of the extent of axial movement of the nail head into the workpiece at the end of the drive stroke.

6. A fluid pressure operated nailer as defined in claim 5 wherein said nosepiece includes an inverted U-shaped slot formed therein in communication with the recess means therein, said inverted U-shaped slot including a pair of parallel longitudinally extending leg portions interconnected at inner ends thereof by a transversely extending bight portion, one of said leg portions having an outer end opening outwardly at the outer end of said fixed nosepiece, another of said leg portions having a closed outer end spaced from the outer end of said nosepiece, said workpiece engaging member having an arm extending transversely therefrom enabling said workpiece engaging member to be moved from a separated condition with respect to said fixed nosepiece into an operative relation therewith by moving said arm longitudinally through the open outer end of said one slot leg portion to the inner end thereof and then transversely through the slot bight portion for sliding longitudinal movement within the other slot leg portion.

7. A fluid pressure operated nailer as defined in claim 6 wherein said workpiece engaging member includes a fixed end portion extending longitudinally from the transversely extending arm in a position outwardly of said U-shaped slot, said motion transmitting mechanism including an elongated member having a longitudinally extending end portion operatively connected with the fixed end portion of said workpiece engaging member.

8. A fluid pressure operated nailer as defined in claim 7 wherein said adjustment means includes a series of longitudinally spaced teeth on each of said end portions interengageable in any one of a plurality of selected adjusted positions with respect to one another and means for maintaining said series of teeth in any selected adjusted position of interengagement.

9. A fluid pressure operated nailer as defined in claim 8 wherein said adjusted position maintaining means includes a leaf spring member mounted on said elongated member for manual movement between an operative position resiliently maintaining the series of teeth of said end portions in the selected adjusted position of interengagement and an inoperative position enabling said end portions to be manually moved from one selected adjusted position of interengagement into another selected adjusted position of interengagement.

10. A fluid pressure operated nailer as defined in claim 1 wherein said workpiece engaging member is normally biased into the extended position thereof by spring means acting operatively between said fixed nosepiece and said workpiece engaging member.

11. A fluid pressure operated nailer as defined in claim 1 wherein said portable housing includes a handle fixed to and extending from said main body portion in a position generally above said magazine assembly, said manually actuated means including a trigger member mounted for digital movement by an operator grasping said handle and a motion transmitting mechanism operatively connected between said trigger member and said workpiece engaging member.

12. A fluid pressure operated nailer as defined in claim 11 wherein said manually actuated means includes adjustment means for operatively connecting said motion transmitting mechanism with said workpiece engaging member selectively in any one of a plurality of adjusted positions so as to provide for the selective adjustment of the extent of movement of the nail head into the workpiece at the end of the drive stroke.

13. A fluid pressure operated nailer as defined in claim 12 wherein said nosepiece includes an inverted U-shaped slot formed therein in communication with the recess means therein, said inverted U-shaped slot including a pair of parallel longitudinally extending leg portions interconnected at inner ends thereof by a transversely extending bight portion, one of said leg portions having an outer end opening outwardly at the outer end of said fixed nosepiece, another of said leg portions having a closed outer end spaced from the outer end of said nosepiece, said workpiece engaging member having an arm extending transversely therefrom enabling said workpieceengaging member to be moved from a separated condition with respect to said fixed nosepiece into an operative relation therewith by moving said arm longitudinally through the open outer end of said one slot leg portion to the inner end thereof and then transversely through the slot bight portion for sliding longitudinal movement within the outer slot leg portion.

14. A fluid pressure operated nailer as defined in claim 13 wherein said workpiece engaging member includes a fixed end portion extending longitudinally from the transversely extending arm in a position outwardly of said U-shaped slot, said motion transmitting mechanism including an elongated member having a longitudinally extending end portion operatively connected with the fixed end portion of said workpiece engaging member.

15. A fluid pressure operated nailer as defined in claim 14 wherein said adjustment means includes a series of longitudinally spaced teeth on each of said end portions interengageable in any one of a plurality of selected adjusted positions with respect to one another and means for maintaining said series of teeth in any selected adjusted position of interengagement.

16. A fluid pressure operated nailer as defined in claim 15 wherein said adjusted position maintaining means includes a leaf spring member mounted on said elongated member for manual movement between an operative position resiliently maintaining the series of teeth of said end portions in the selected adjusted position of interengagement and an inoperative position enabling said end portions to be manually moved from one selected adjusted position of interengagement into another selected adjusted position of interengagement.

* * * * *